US005560492A

United States Patent [19]

Eren

[11] Patent Number: 5,560,492

[45] Date of Patent: Oct. 1, 1996

[54] DISPLAY DEVICE

[76] Inventor: Mustafa Eren, Maslak Gazeteciler Sitesi Blok A-7 Daire 3, Istanbul, Turkey

[21] Appl. No.: 568,250

[22] Filed: Dec. 6, 1995

[51] Int. Cl.[6] ..... B65D 75/00

[52] U.S. Cl. ..... 206/756; 206/779

[58] Field of Search ..... 206/736, 756, 206/757, 762, 763, 764, 766, 745, 746, 747, 775, 779

[56] References Cited

U.S. PATENT DOCUMENTS

| | | | |
|---|---|---|---|
| D. 350,479 | 9/1994 | Livezey . | |
| 1,599,492 | 9/1926 | Rothschild | 206/762 |
| 1,713,758 | 5/1929 | Horwath . | |
| 2,302,919 | 11/1942 | Snider . | |
| 3,002,608 | 10/1961 | Zwickey | 206/763 |
| 3,050,183 | 8/1962 | Mueller, Jr. . | |
| 3,139,255 | 6/1964 | Palm . | |
| 3,376,975 | 4/1968 | Brothers . | |
| 3,532,310 | 10/1970 | Finfrock . | |
| 3,847,292 | 11/1974 | Collura et al. . | |
| 4,420,077 | 12/1983 | Roccaforte . | |
| 4,503,975 | 3/1985 | Meyers et al. . | |

*Primary Examiner*—Jacob K. Ackun

*Attorney, Agent, or Firm*—St. Onge Steward Johnston & Reens

[57] ABSTRACT

A display device formed of a sheet of flexible material which may be attached by the top portion thereof to a base. A cut in the middle portion of the strip forms a support flap to which the lower portion of the strip is attached. To attach the lower portion to the support flap, the lower portion is bent underneath and upwards to the support flap. Upon bending the strip, the cut forms a window in which to insert an article for display. The lower portion of the strip is attached to the support flap by sliding a slit in one over a retaining tab formed in the other.

10 Claims, 2 Drawing Sheets

DISPLAY DEVICE

FIELD OF THE INVENTION

This invention relates to display devices and, in particular to point-of-purchase displays.

BACKGROUND OF THE INVENTION

Article displays, such as point-of-purchase displays, are commonly used today. These displays may be for single or multiple items and may support the articles in a number of ways. A common method to display and support articles is with the use of a hook which is inserted into a hole in the packaging of the article. Typically the packaging is cardboard or plastic and is displayed in such a manner so that it can be conveniently taken from the display by the purchaser.

An example of display packaging which is intended to be taken along with the product is U.S. Pat. No. 4,503,975 to Meyers which discloses a display package for an article such as a bottle of nail polish. The Meyers display device is formed by punching, folding and gluing a section of cardboard around the article. This type of display device is effective, however, it does not allow the item to be removed from the support, thus it is not reusable. Also, the packaging must be glued together which requires drying time and also requires pre-assembly at a site other than the one where the packaging is to be used.

Another method for displaying and supporting articles is to provide a reusable display device which allows the article to be removed when selected while leaving the display intact. An example of such a display device is U.S. Pat. No. 3,376,975 to Brothers which discloses a stamped, folded and glued section of cardboard in which single articles may be displayed and which includes a hole for a hook support. Since articles may be removed from the Brothers display device, it is an effective reusable display device. However, as with the Meyers device, the Brothers' display also requires gluing and pre-assembly.

What is desired, therefore, is a display device which is reusable, which requires a minimum amount of pre-assembly work and which may be assembled quickly and which may be assembled and disassembled many times.

SUMMARY OF THE INVENTION

It is an object of the invention to provide a reusable display device which requires a minimum amount of pre-assembly and which may be quickly assembled at the point of display.

Another object of the invention is to provide a display device which may be assembled and disassembled many times.

Another object of the invention is to provide a display device which may be shipped in a flat configuration and assembled at the point of display without the use of adhesives.

Still another object of the invention is to provide a display device which does not require any creasing during assembly.

Yet another object of the invention is to provide a display device which is formed from a single strip of flexible material attached to a support.

In accordance with one form of the display device of the present invention, a sheet of flexible material is attached by the back of its top portion to a base or other suitable support. A cut, which can be in a middle portion of the strip, is shaped so as to form a support flap, which remains hingedly connected to the strip. A second cut, in the support flap, forms a retaining tab which is so shaped and oriented as to enable it to engage a slit in a lower portion of the strip when it is bent underneath and upwards. When the tab engages the slit the flap captures and retains the lower strip portion and the space in the strip vacated by the flap forms an opening leading into a receptacle in which an article for display can be inserted while being seated on the backside of the upwardly bent lower portion of the strip.

With a display device in accordance with the invention a flat sheet of material can be conveniently altered into a display device. The sheet need only be die cut with appropriate slits and cuts and can be shipped in flat form to the place of use. Erection of the display device from the sheet form is readily accomplished. A plurality of receptacles on a single sheet can be formed.

The invention and its particular features and advantages will become more apparent from the following detailed description considered with reference to the accompanying drawings.

DETAILED DESCRIPTION OF THE INVENTION

Figure 1:
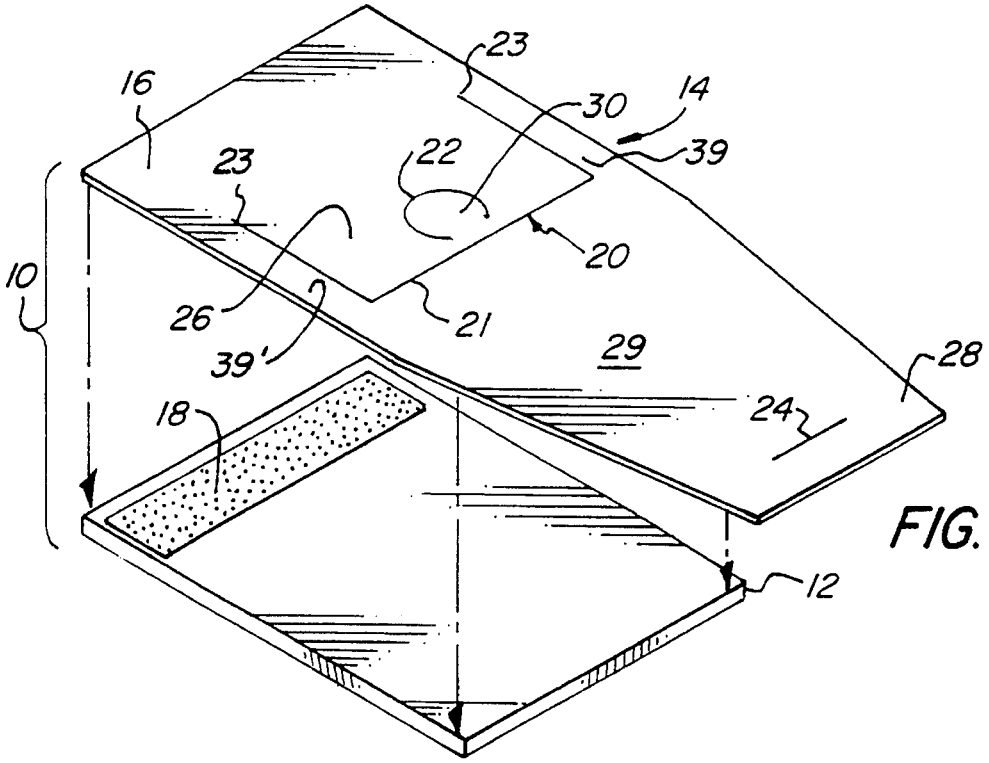
FIG. 1 is a an exploded, perspective view of a display device of the present invention showing the optional step of adhering the top portion of the flexible strip to the base and showing the strip in a flat configuration.

Referring to FIGS. 1 through 4, a display device 10 consists of a base 12 and a strip of flexible material 14. The strip can be transformed into a display by bending it so that a lower portion 28 can be retained by an inwardly bent flap 26 to form a receptacle 15 in which an article such as 17 can be placed for display through an opening 37 formed by the bent flap 26.

The back of the strip 14 may be attached by a top portion 16 thereof to a base 10 by an adhesive 18. This adhesive 18 is optional and, if used, is preferably the only adhesive employed in the invention.

Strip 14 includes a number of cuts 20, 22 and a slit 24 therethrough. Cut 20 forms a support flap 26 for supporting a lower portion 28 of strip 14 and forming an opening 37 leading into the. Cut 22 and slit 24 form a retaining tab 30 and a retaining slit 32, respectively, for attaching the lower portion 28 of strip 14 to support flap 26. Since the strip 14 is flexible, the retaining tab 30 is hingedly connected to the strip 14 and may be bent away from the strip 14 for insertion into the retaining slit 32.

Preferably, the shape of cut 20 is rectangular, however, other shapes are within the present invention. It is important however, that there is some part such as 21 of cut 20 which is closer to lower portion 28 of strip 14 than the endpoints 23 of cut 20. Preferably, the shape of cut 22, which forms the retaining tab 30, is substantially semicircular, however, other shapes for tab 30 are within the scope of the invention.

Preferably, cut 22 is located within support flap 26 and the matching slit 24 is located on the lower portion 28 of strip 14. However, the placement of cut 22 and slit 24 could be reversed. In case of such reversal the orientation of the retaining tab 30 is also reversed so that the tendency of the lower portion 28 to withdraw from attachment to flap 26 is properly restrained. Moreover, other means of attaching lower portion 28 to support flap 26, such as by use of adhesives or other attachment devices, such as staples and the like, are within the present invention.

The middle and lower portions 28, 29 of strip 14 are shown with tapered sides 31—31' though this shaping of the sides is not necessary. Strip 14 can be made of a strong, clear thermoplastic material, though other bendable materials can be used and the material need not be transparent and could be translucent or opaque. The base can be made of any suitable material such as wood or cardboard or plastic.

Figure 2:
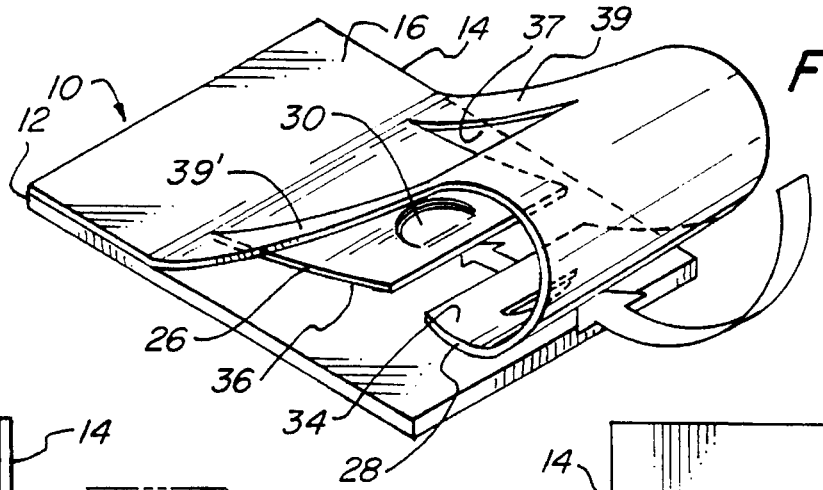
FIG. 2 is a perspective view of the display device of FIG. 1 showing the step of bending the lower portion of the strip underneath and toward the support flap formed in the strip.

Referring to FIGS. 1 and 2, to form display device 10, the back of the top portion 16 of the strip 14 may be attached to the base 12. This can be done with an adhesive or such other suitable fastening material. Next, the lower portion 28 is folded underneath itself toward the support flap 26 and, the retaining tab 30 inserted through the slit 24. Preferably, the lower portion 28 is positioned between the support flap 26 and the base 12 such that the back surface 34 of the lower portion 28 is in contact with the back surface 36 of the support flap 26. This ensures that articles being inserted into the display will not snag on the edge 36 of the lower portion 28 or on the retaining tab 30.

Figure 3:
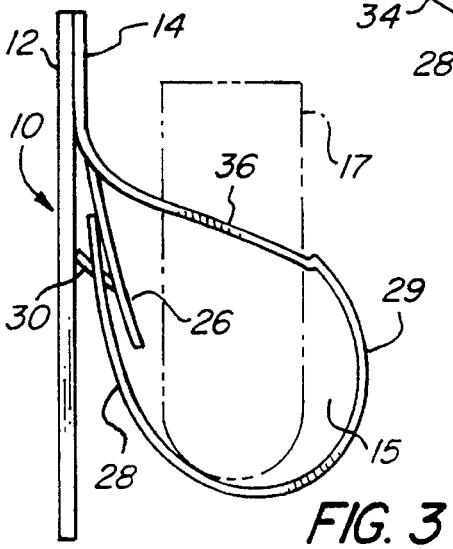
FIG. 3 is a side view of the display device of FIG. 2 showing the lower portion of the strip attached to the support flap and showing an article inserted through the window formed in the strip.
Figure 4:
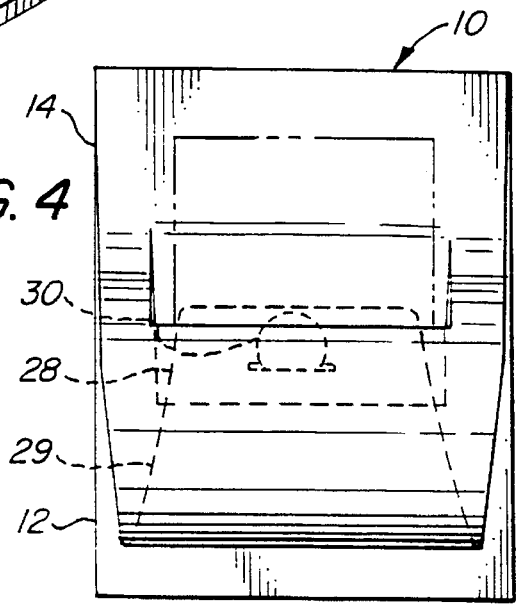
FIG. 4 is a front view of the display device of FIG. 3.

Referring to FIG. 2, 3 and 4 when the strip 14 is bent and retaining tab 30 and retaining slit 24 are interengaged by inserting the retaining tab 30 through the retaining slit 24, the support flap 26 is hinged away from strip 14 and is positioned relatively close to the base 12. The space vacated by the bent flap 26 forms a window 37 through which one can insert display articles such as 17 which seat on the back side of the upwardly bent lower portion 28 of strip 14.

Side portions 39—39' of the strip 14 along the support flap 26, after bending of the lower portion 28 and bending of flap 26, extend outwardly to provide side supports for an article 17. A loop is formed by the middle portion 29 of the strip 14 as it extends outwardly and below the opening 37 to form front and bottom walls for the receptacle 15 while the lower portion 28 of strip 14 forms a back wall.

Figure 5:
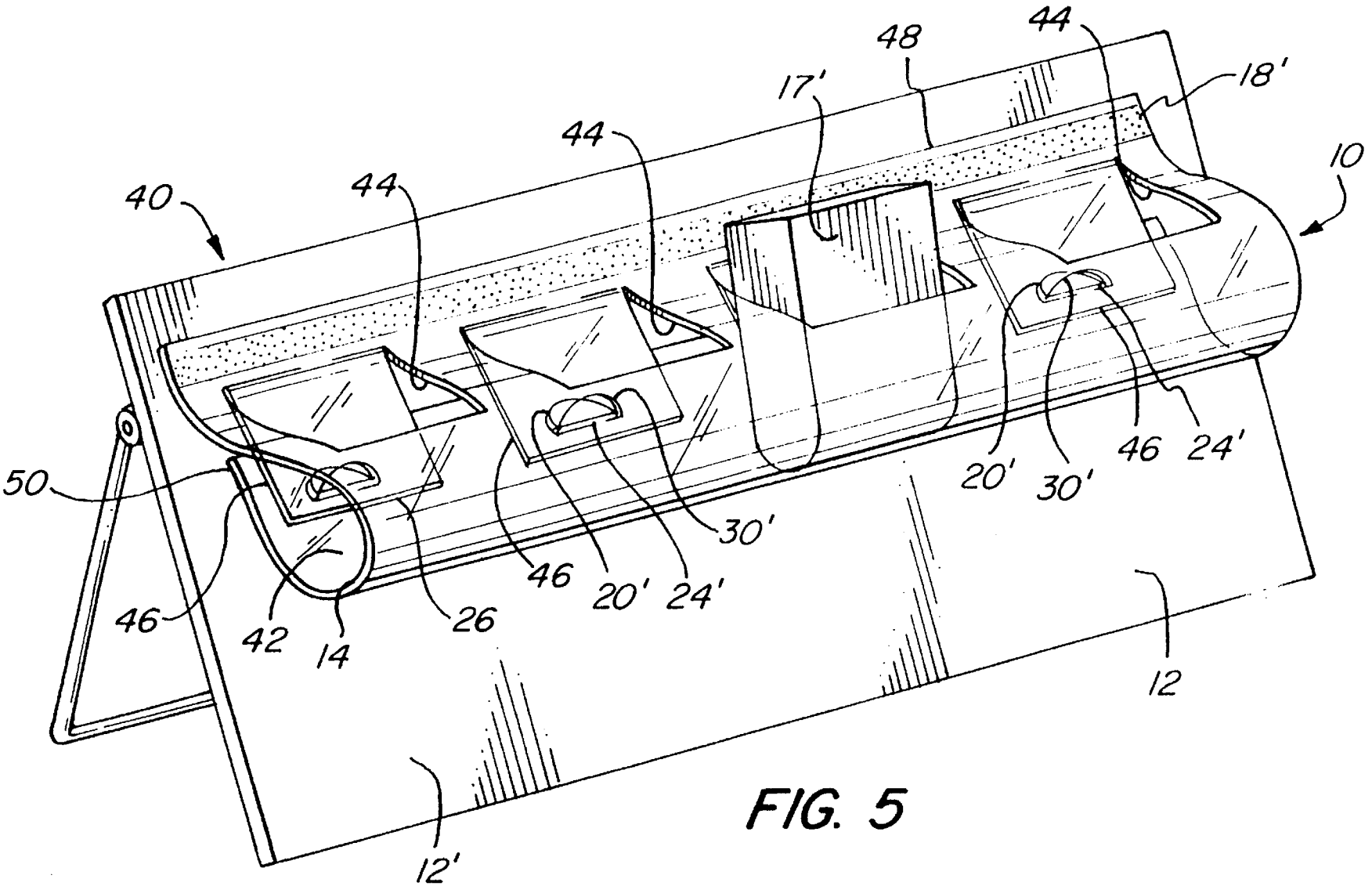
FIG. 5 is an isometric view of the present invention showing a single transparent strip forming multiple display bins.

Referring to FIG. 5, a display device 40 is shown to form a single receptacle 42 with a plurality of spaced apart receptacle windows 44 formed by spaces vacated by inwardly bent support flaps 46. The flaps 46 like those shown in FIGS. 1–4 are hingedly connected. The display device 40 is formed of a single transparent strip 48 including a plurality of cuts 20' to form tabs 30' and slits 24' for enabling support flaps 46 to be attached to the lower portion 50 of strip 48. Preferably, the lower portion 50 of the strip 48 is attached to each support flap 46 to provide a strong support for an article such as 17', however lower portion 50 need not be attached to each support flap 46. The display device 40 may be attached to a base 12' by an adhesive 18' on the top portion thereof.

Although the invention has been described with reference to a particular arrangement of parts, features and the like, these are not intended to exhaust all possible arrangements or features, and indeed many other modifications and variations will be ascertainable to those skilled in the art.

What is claimed is:

1. A display device for removable articles comprising:

a generally flat strip of flexible material having an upper portion containing a first cut sized and shaped to define a support flap hinged to the upper portion, said strip having a lower portion;

said support flap and said lower portion of the strip being provided with at least one of a second cut and a slit, said second cut and said slit forming respectively a retaining tab and a retaining slit sized to receive the retaining tab;

with the retaining tab being so oriented that, when the support flap is hinged away from said strip and when the lower portion of the strip is bent around to at least partially overlap said support flap, the retaining tab and the retaining slit can be interengaged to transform the lower portion of the strip into a receptacle of said display device having an opening through which an article can be inserted.

2. The display device as in claim 1 wherein said support flap has said second cut forming said retaining tab and wherein said lower portion of said strip has said slit.

3. The display device as in claim 2 wherein said strip of flexible material has a back surface overlapping at least a portion of said support flap; and wherein said retaining tab and slit maintain the back surface of said support flap in contact with said back surface of said lower portion.

4. The display device as in claim 3 further comprising an upright support and means for affixing said upper portion of said strip to said upright support.

5. A display device for removable articles comprising:

a generally flat strip of flexible material having an upper portion containing a plurality of first cuts sized and shaped to define a plurality of support flaps hinged to the upper portion, said strip having a lower portion;

a plurality of said support flaps and said lower portion of the strip being provided with at least one of a second cut and a slit, said second cut and said slit forming respectively hinged retaining tabs and retaining slits sized to receive said retaining tabs;

with the retaining tabs being so oriented that, when said support flaps are hinged away from said strip and when the lower portion of the strip is bent around to at least partially overlap said hinged support flaps, the retaining tabs and the retaining slits can be interengaged to transform the lower portion of the strip into a bottom of said display device and to form a plurality of openings through which articles can be inserted.

6. The display device as in claim 5 wherein said support flaps have said second cuts forming said retaining tabs and wherein said lower portion of said strip has said retaining slits.

7. The display device as in claim 6 wherein said strip of flexible material has a back surface extending over said support flaps and said lower portion; and wherein said back surface of said support flaps is in contact with said back surface of said lower portion.

8. The display device as in claim 7 and further including an upright support and means for affixing said upper portion of said strip to said upright support.

9. A display device for removable articles comprising:

a strip of flexible material having an upper portion containing at least one first cut sized and shaped to define a support flap hinged to the upper portion, said support flap having a second cut shaped and sized to form a retaining tab hinged to said support flap; said strip having a lower portion with a slit shaped to receive the retaining tab when the lower portion is bent around to partially overlap the support flap so that the lower portion forms a bottom of said display device.

10. A display device as in claim 9 further comprising a plurality of first cuts in said strip forming a plurality of support flaps hinged to said upper portion; wherein a plurality of said support flaps further comprise one of said second cuts shaped and sized to form a retaining tab hinged thereto; and wherein said lower portion further comprises a plurality of slits forming slits each shaped and sized to receive one of said retaining tabs when said lower portion is bent around to partially overlap the support flaps so that the lower portion forms a bottom of said display device.

* * * * *